United States Patent [19]

Troncoso et al.

[11] Patent Number: 4,748,963

[45] Date of Patent: Jun. 7, 1988

[54] ARCHERY BOW ASSEMBLY

[75] Inventors: Vincent F. Troncoso; Fernando Troncosco, Jr., both of Montrose, Colo.

[73] Assignee: Golden Key Futura, Inc., Montrose, Colo.

[21] Appl. No.: 15,310

[22] Filed: Feb. 17, 1987

Related U.S. Application Data

[63] Continuation-in-part of Ser. No. 893,592, Aug. 6, 1986, abandoned.

[51] Int. Cl.[4] ..... F41B 5/00; F41D 10/00

[52] U.S. Cl. ..... 124/24 R; 124/41 A

[58] Field of Search ..... 124/41, 24 R, 88, 86, 124/23 R

[56] References Cited

U.S. PATENT DOCUMENTS

| | | | |
|---|---|---|---|
| 3,244,161 | 4/1966 | Jenson | 124/24 R |
| 3,606,875 | 9/1971 | Carella | 124/41 A |
| 3,896,782 | 7/1975 | Carella | 124/41 A |
| 3,935,854 | 2/1976 | Tronosco, Jr. | 124/24 R |
| 4,577,612 | 3/1986 | Zell | 124/24 R |
| 4,632,087 | 12/1986 | Cline | 124/41 A |
| 4,664,093 | 5/1987 | Nunemaker | 124/41 A |

OTHER PUBLICATIONS

Nelson Arrow Holder, (Nelson), 4/27/54.

Hunter II, "Archery Mag.", 1975.

*Primary Examiner*—Richard C. Pinkham

*Assistant Examiner*—Mark S. Graham

*Attorney, Agent, or Firm*—Donald E. Nist

[57] ABSTRACT

The archery bow assembly includes an archery bow having a riser with arrow window, arrow rest and handle, a pair of limbs and a bowstring. The assembly also includes a novel arrow holder which prevents an arrow from inadvertently rolling off the rest but which automatically releases the arrow as the arrow is drawn during shooting of the bow. The holder includes a flexible resilient elongated line of rubber or the like having a high frictional resistance with the surface of the arrow, connectors at one or both opposite ends of the line, an anchor bolt or the like anchoring one end of the line through its connector to the riser, preferably at the rear end thereof, and a smooth surfaced slide pin or the like interconnected to and projecting rearwardly from the riser and slideably receiving the connector at the opposite end of the line, after the line is passed over the arrow when the latter is on the rest. Preferably, the pin is carried by a crossbar. As the arrow is drawn rearwardly, the line travels with it until the connector slides off the slide pin so that the line automatically releases the arrow and then flexes out of the window area and arrow path. In order to accommodate various arrow shaft diameters, bow riser configurations, arrow rests and the like, the pin angle and length are adjustable, as is its position behind the bow window. The crossbar is also adjustable in length and angle.

7 Claims, 3 Drawing Sheets

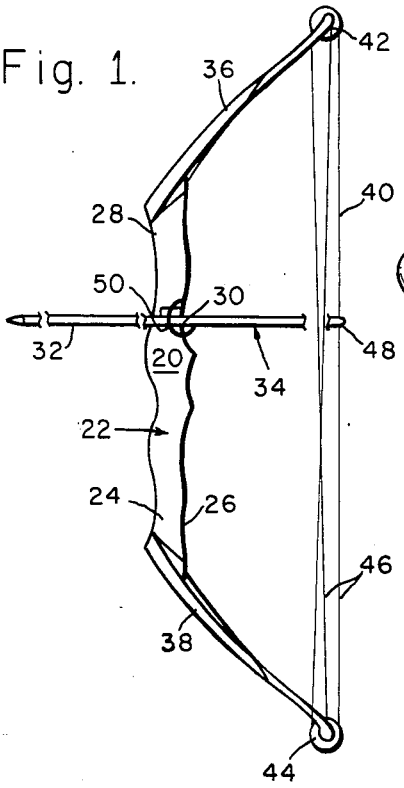
Fig. 1.
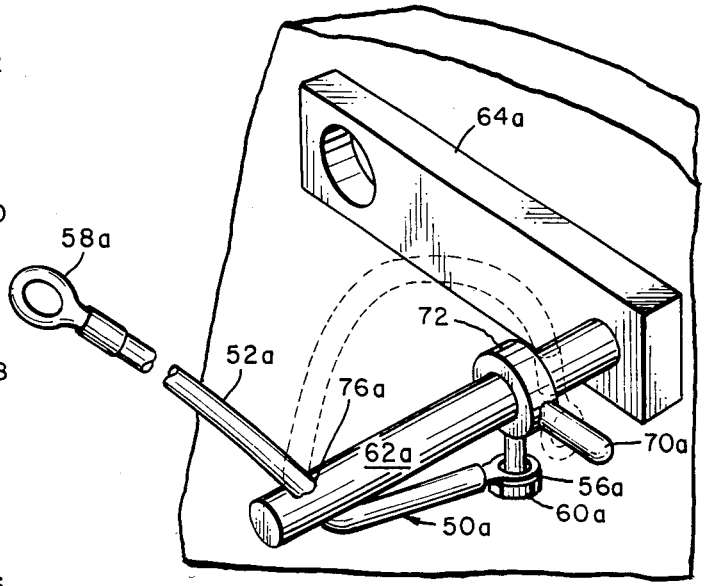
Fig. 3.
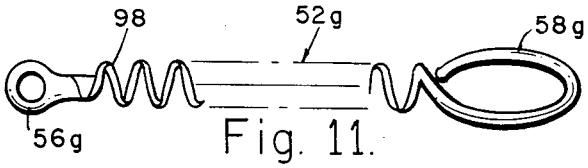
Fig. 11.
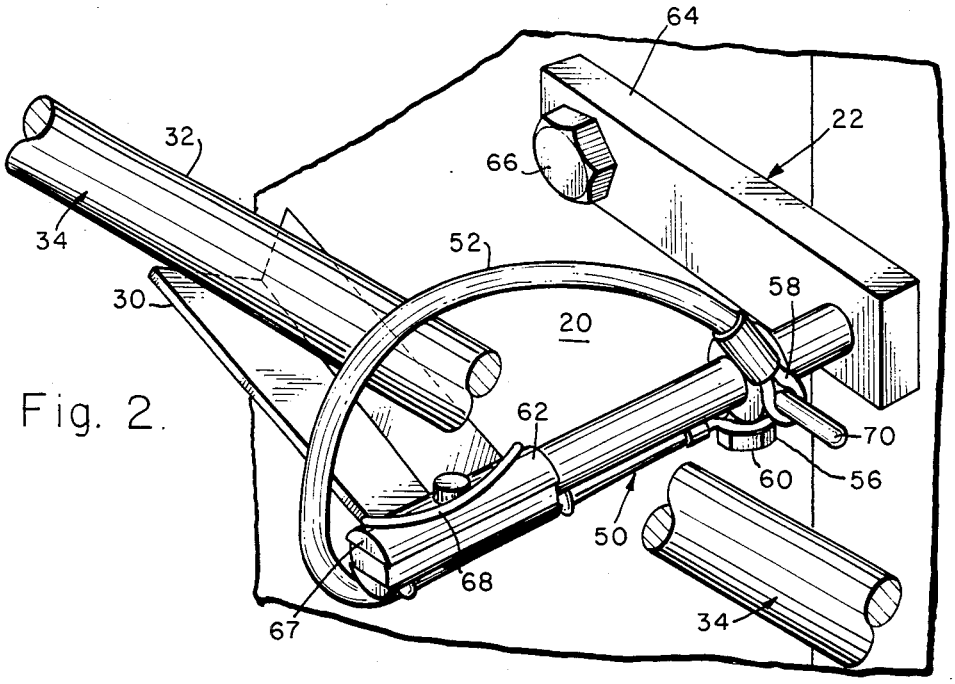
Fig. 2.
Fig. 10.
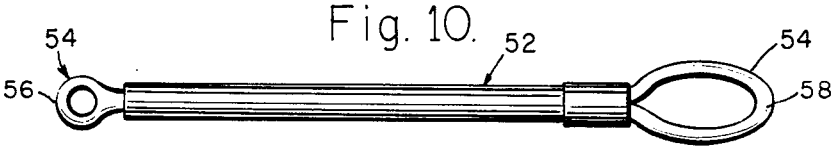

Fig. 4.
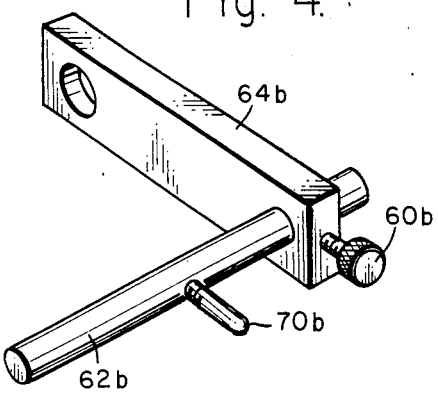
Fig. 5.
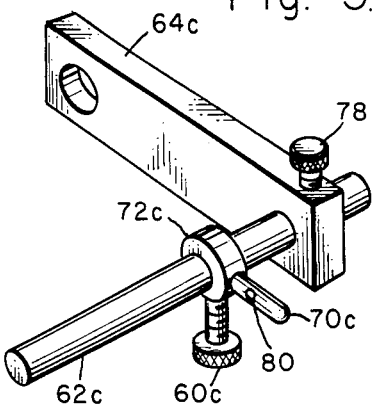
Fig. 6.
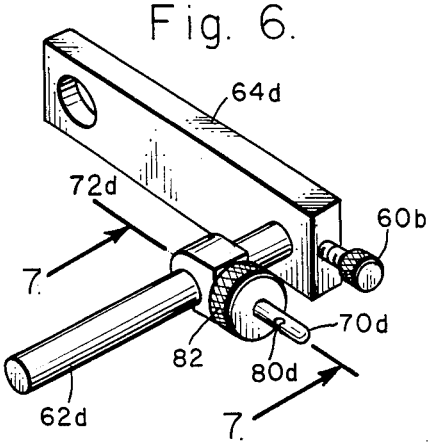
Fig. 7.
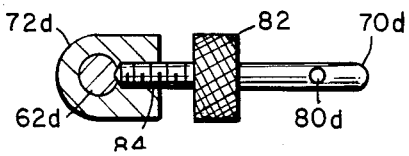
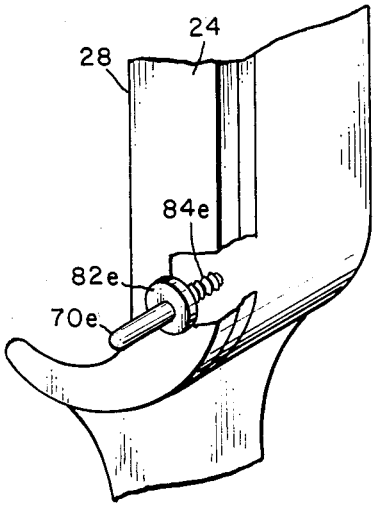
Fig. 8.
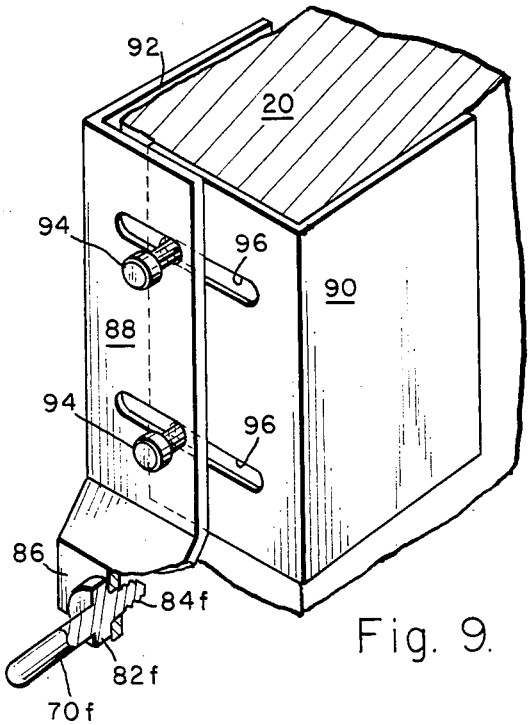
Fig. 9.

ARCHERY BOW ASSEMBLY

The present application is a continuation-in-part of copending U.S. patent application, Ser. No. 893,592, filed Aug. 6, 1986, now abandoned, entitled Improved Archery Bow Assembly, of which the inventors and assignee are the same as the present inventors and assignee.

BACKGROUND OF THE INVENTION

1. Field of the Invention

The present invention generally relates to sports equipment and more particularly to an improved archery bow assembly having a novel arrow holder.

2. Prior Art

There are many types of archery arrow holders which have been developed. Most are clumsy, bulky and expensive. The only arrow holders currently in favor are those which are in the form of racks connected to the bow riser on the side opposite that facing the arrow window. Such holders releasably secure the arrows by V-shaped clips. An arrow must be manually inserted with both hands into and manually removed from the holder before the archer can string it on the bowstring, then place it on the arrow rest, draw and shoot the arrow. Obviously, the bow is not ready to shoot instantly, as may be required during hunting. Moreover, it is difficult and inconvenient to have to use both hands to place a sharp arrow in a holder, since the bow must then be laid down or braced against an object. If, instead, the rear end of an arrow is merely placed on the bowstring and the arrow shaft is allowed to sit on the arrow rest while the bowhunter carries the bow in the field, in order to permit instant shooting when a target animal appears, any substantial tilting and/or bumping of the bow, such as is normally encountered when a bowhunter travels through rough terrain, will cause the arrow to roll off the rest. The bowhunter must then continually reseat the arrow on the rest or else risk that firing the bow will result in a grossly inaccurate shot, with possible damage to the arrow, hunter and/or bow.

An improved bow arrow holder is set forth in U.S. Pat. No. 3,606,875, issued Sept. 21, 1971 to R. F. Carella. That holder comprises in one embodiment a generally U-shaped horizontally aligned bracket connected by the lower leg thereof to the end of the bow handle facing the archer at about the level of the bow's arrow rest. The free-standing forwardly directed upper leg of the bracket slidably receives a ring connected to a strap, the other end of which bears a second ring slidably received on the lower bracket leg. The strap is intended to loop over an arrow shaft and pin it to the arrow rest, but fall away as the arrow is shot forward out of the bow.

A second embodiment in the patent employs a horizontal post with an upwardly angled free end. The post is connected to the bow handle and projects toward the archer. The post holds both rings of the strap, which releases from the arrow shaft as the bowstring is drawn.

A difficulty with this device is its lack of adjustability. The post and U-shaped bracket are in a fixed position directly in line with the end of the sidewall defining the bow's arrow window. Considerable side pressure or torque is then exerted by the arrow holder, pulling the arrow shaft toward the bow window sidewall even though the arrow rest may project well out into the window away from the sidewall and hold the arrow in the position to allow proper arrow vane or feather clearance. The torquing effect can throw the point of the arrow off the aiming line, with resulting poor shooting accuracy. Moreover, because of the difference in size and shape of various arrow rests, cushion plungers, bow sidewall thicknesses and arrow shaft diameters, as well as various bow handle shapes, it is important to be able to provide an arrow holder with full adjustability as to angle of release, effective strap length and the like. The Carella bow holder totally fails in that regard, being made of rigid, non-adjustable, non-repositionable components.

Accordingly, there is still a need for an improved type of archery arrow holder which will firmly and safely retain the arrow in place on the rest in any desired location in the bow window without exerting side torque on the arrow while preventing dislodgment of the arrow when the archer (bowhunter) carries the bow. The holder should be easy to install on, adjust and remove from the bow and just as easy to use. It should also be completely adjustable to accommodate various arrow rests, arrow shaft diameters, bow sidewall thicknesses and other factors. Preferably, it should be engageable by one hand with the arrow, and should automatically release the arrow when the arrow is drawn by the bowstring during shooting the arrow.

SUMMARY OF THE INVENTION

The improved archery bow assembly of the present invention satisfies all the foregoing needs. The assembly is substantially as set forth in the Abstract. Thus, it includes an archery bow having a riser with handle, arrow rest and window, a pair of limbs and a bowstring, and a novel arrow holder.

The holder is simple, inexpensive, durable and efficient. It comprises an elongated, flexible, resilient line, preferably of stretchable elastomeric material such as synthetic or natural rubber or plastic, with a connector hook, loop or eye at each end, one end of which is firmly anchored by its connector to the bow riser, preferably adjacent the end of the riser nearest the archer at the window, while the other end of which is slidably received by its connector on a slide pin projecting rearwardly from the riser window area. The length of line therebetween is looped over the arrow when on the rest, pinning it to the rest. The line is of high drag or friction resistant material relative to the arrow shaft surface, so that when the arrow is drawn by the bowstring, the line adheres to it and travels with it until the connector slides off the slide pin, whereupon the arrow is released automatically, the line flexing and/or falling away from the arrow and arrow flight path so that the arrow can be shot without interference therewith.

The slide pin and anchor are fully adjustable as to angle and position and can be directly connected to the riser or to a crossbar or other support held by a block or other component secured to the riser. The crossbar can also carry the arrow rest. In another embodiment, the slide pin also bears the anchor and can be affixed to the riser face (rear end) directly or by one or a pair of plates, so as to be fully adjustable as to length and angle. The line can be coiled spring, with or without a non-sliding rubber sheath, or can be a rubber band held by two hooks or the like. In a further embodiment, the connector comprises a plate having a plurality of holes in one end thereof through which the line is threaded to firmly and adjustably hold one end of the line, so that an eye on that line end is unnecessary. Moreover, that plate bears on its opposite end a cutaway portion to easily secure the plate to the bow sidewall.

DRAWINGS

FIG. 1 is a schematic side elevation, partly broken away, of a first preferred embodiment of the improved archery assembly of the present invention;

FIG. 2 is a schematic perspective view of the arrow holder and arrow rest portions of the assembly of FIG. 1;

FIG. 3 is a schematic, perspective view of a second preferred embodiment of the arrow holder of the present invention;

FIG. 4 is a schematic perspective view of a third preferred embodiment of the block, slide and anchor portions of the arrow holder of the present invention;

FIG. 5 is a schematic perspective view of a fourth preferred embodiment of the block, slide and anchor portions of the arrow holder of the present invention;

FIG. 6 is a schematic perspective view of a fifth preferred embodiment of the block, slide and anchor portions of the arrow holder of the present invention;

FIG. 7 is a schematic side elevation, partly in cross-section, of the slide pin portion of the arrow holder of FIG. 6;

FIG. 8 is a schematic perspective view of a sixth preferred embodiment of the slide and anchor portions of the improved arrow holder of the present invention;

FIG. 9 is a schematic perspective view of a seventh preferred embodiment of the mounting, slide and anchor portions of the arrow holder of the present invention;

FIG. 10 is a schematic side elevation of the line of FIG. 2;

FIG. 11 is a schematic side elevation of a modified version of the line of the arrow holder of the present invention;

DETAILED DESCRIPTION

FIGS. 1,2 and 10

Figure 13:
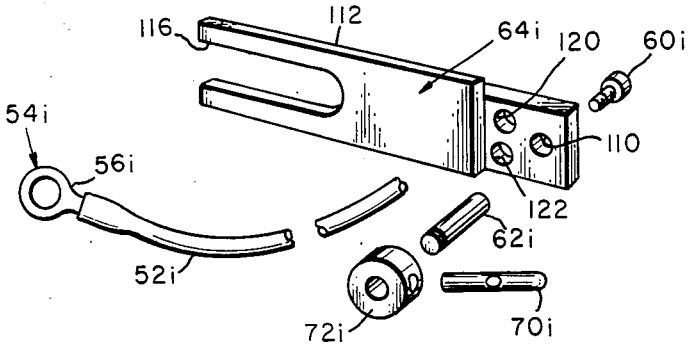
FIG. 13 is a schematic perspective exploded view of another embodiment of the improved arrow holder of the present invention.
Figure 14:
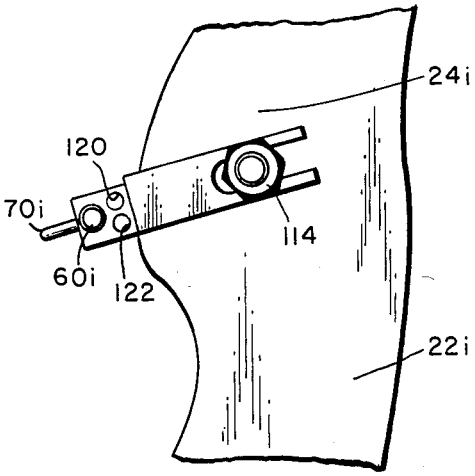
FIG. 14 is a schematic side elevation, partly broken away, of the holder of FIG. 13 in place on the outside of an archery bow sidewall.
Figure 15:
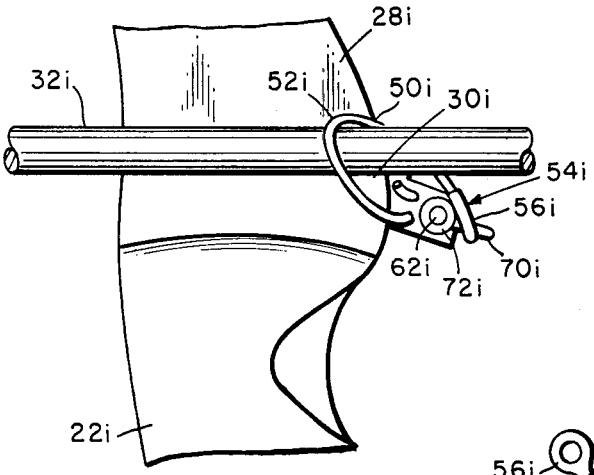
FIG. 15 is a schematic side elevation, partly broken away, of the holder of FIG. 13 releasably holding an arrow shaft on an arrow rest in the window of an archery bow; and, FIG. 16 is a schematic rear perspective view of the holder of FIG. 13 in association with an arrow rest and cushion plunger on an arrow bow.

Now referring more particularly to FIGS. 1, 2 and 10, a first preferred embodiment of the improved archery bow assembly of the present invention is schematically depicted therein. Thus, assembly 20 is shown which comprises an archery bow 22 having a central riser 24 bearing a handle 26, and an arrow window 28 in which an arrow rest 30 is secured and upon which the shaft 32 of an arrow 34 can releasably rest. Bow 22 also includes a pair of limbs 36 and 38 connected to opposite ends of riser 24 and a bowstring 40 interconnected to limbs 36 and 38, in this instance, through pulley wheels 42 and 44 and pulley cord 46, since bow 22 depicted is a compound bow. It will be understood that bow 22 could be, if desired, a non-compound bow.

The rear nock end 48 of arrow 34 is clipped on to bowstring 40, while an improved arrow holder 50 holds arrow 34 firmly in place on rest 30, preventing it from rolling off when bow 22 is bumped, tilted, etc., as during carrying while on a bowhunt.

Holder 50 comprises, as shown more particularly in FIGS. 2 and 10, an elongated, flexible, resilient line 52, preferably of stretchable elastomeric rubber, plastic or the like and having a separate connector 54 in the form of an eye secured to each of its two opposite ends. As shown in FIG. 10, eye 56 may be of metal and is smaller than eye 58, but otherwise similar. Line 52 can be flat, round or of any other suitable transverse cross-section. Eye 56 is anchored by a small threaded bolt 60 to the underside of a bar 62 which extends transversely behind window 28 and is releasably secured therein by adjustable connection to the rear end of a forwardly projecting block 64 secured by bolt 66 to riser 24 in window 28. With this arrangement, bar 62 can be slid transversely to adjustably position eye 56 behind window 28 for zero side torque but adequate vane clearance.

Bar 62 at its free end 67 bears forwardly and upwardly extending arrow rest 30 upon which arrow shaft 32 sits. Line 52 passes under bar 62 and is held thereagainst by a spring bracket 68, or the like then passes around free end 67 and loops freely up and over shaft 32 and proceeds to a smooth surfaced slide pin 70 screwed into the rear of bar 62 and projecting rearwardly therefrom. Large eye 58 is of readily slidable material such as smooth metal, tetrafluoroethylene or the like and is slidably received over pin 70 so that line 52 releasably holds shaft 32 firmly against rest 30, preventing its dislodgment. The length of pin 70 is adjustable by screwing it more or less into bar 62 to control the ease and rapidity with which eye 58 slips off of pin 70 as shaft 32 moves rearwardly during drawing of bowstring 40. Moreover, the angle of pin 70 is adjustable by rotating bar 62 for the same purpose. Thus, line 52 has sufficiently high drag or frictional resistance relative to the surface of shaft 32 so that when shaft 32 moves rearwardly line 52 moves with it, effecting automatic release of arrow 34 from holder 50. Line 52 then drops below shaft 32 and out of the flight path of arrow 34.

An existing arrow rest array could be readily modified to provide the support means for the novel arrow holder 50 of the present invention. In any event, holder 50 is simple, durable, fully adjustable and efficient. Line 52 can be looped over shaft 32 with one hand and no hands are needed to release line 52 which, when released, flexes and falls away from window 28 and the flight path of arrow 34, as described above. Holder 50 accommodates all sizes of arrow shafts, release angle positions, bow handle configurations, arrow rest positions and the like.

FIGS. 3-9 and 11-16 display modified versions of assembly 20 and portions thereof. Components similar to those of FIGS. 1, 2 and 10 bear the same numerals, but are succeeded by the letter "a" in FIG. 3, the letter "b" in FIG. 4, the letter "c" in FIG. 5, the letter "d" in FIG. 6 and 7, the letter "e" in FIG. 8, the letter "f" in FIG. 9, the letter "g" in FIG. 11, the letter "h" in FIG. 12 and the letter "i" in FIGS. 13-16.

FIG. 3

FIG. 3 shows block 64a, crossbar 62a and arrow holder 50a. The position and angles of these three components can be readily adjusted. Bar 62a can be rotated and slid in and out of block 64a which can be tilted as desired. Holder 50a includes line 52a with eyes 56a and 58a, bolt 60a and pin 70a on a collar 72 of bar 62a. The position of collar 72 is controlled by bolt 60a therein. rotation and sliding of collar 72 on bar 62a, by loosening and retightening bolt 60a, repositions pin 70a as desired. Line 52a is held in position relative to bar 62a by passing up through an opening 76 therein. Bar 62a does not include an arrow rest. Holder 50a functions similarly to holder 50 and is fully adjustable.

FIG. 4

FIG. 4 shows block 64b, crossbar 62b, pin 70b and bolt 60b, the latter being secured to the rear end of block 64b rather than to bar 62b or a collar thereon. With this arrangement, bolt 60b releasably holds bar 62b in a desired horizontal and rotated position; block 64b can be tilted and pin 70b can be adjusted in length by screwing it in and out of bar 62b.

FIG. 5

FIG. 5 shows block 64c, bar 62c, pin 70c threaded into collar 72c and bearing a turnhole 80 and bolt 78 extending down through the rear end of block 64c and used to releasably lock bar 62c to block 64c. Bolt 60c is provided to releasably lock collar 72c. Accordingly, these components are fully and easily adjustable as to position and angle.

FIGS. 6 and 7

FIGS. 6 shows block 64d, bar 62d releasably locked thereto by bolt 60d and collar 72d bearing pin 70d with hole 80d. Pin 70d has an expanded knurled portion 82 (with threaded shaft 84 connected thereto) to facilitate turning it into and out of collar 72d for adjustment. Accordingly, these components also are fully adjustable.

FIG. 8

FIG. 8 shows pin 70e connected to the face (rear end) of riser 24 adjacent window 28 and bearing portion 82e with threaded shaft 84e. Shaft 84e serves as the anchor for one end of the holder line (not shown) in place of bolt 60.

FIG. 9

FIG. 9 shows pin 70f with expanded portion 82f and shaft 84f, the latter being utilized in place of bolt 60, and passing through a depending readily bendable portion 86 of an L-shaped plate 88 secured over a similar L-shaped plate 90 at the face (rear) of riser 24 by an inner adhesive strip 92 and by screws 94 passing into slots 96 of plate 90. Full adjustability of the position and angle of pin 70f is provided. Plates 88 and 90 fit various widths and depths of window-defining bow handle sidewalls.

FIG. 11

FIG. 11 shows a modified version of the line of the present holder. Thus, line 52g is shown as an elongated coiled spring 98 having eyes 56g and 58g of similar sizes at opposite ends thereof.

FIG. 12

Figure 12:
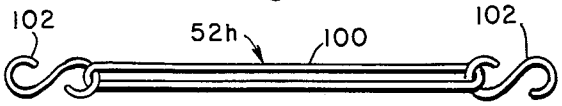
FIG. 12 is a schematic side elevation of a further version of the line of the arrow holder of the present invention.

A further version of arrow holder line is depicted in FIG. 12. Thus, line 52h is shown in the form of a rubber band 100 having a pair of S-shaped hooks 102 at opposite ends thereof instead of eyes 56 and 58.

It will be understood that components of FIGS. 3–9, 11 and 12 are generally interchangeable with those of FIGS. 1, 2 and 10, with similar results and advantages.

FIGS. 13–16

Figure 16:
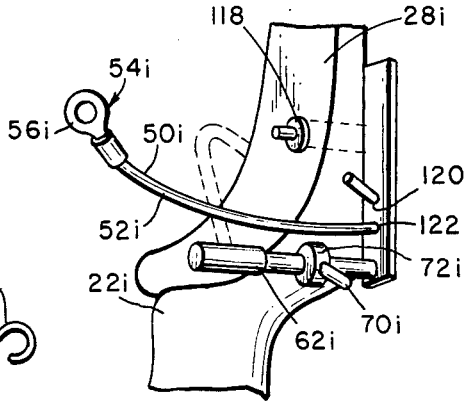

A further embodiment of the improved arrow holder of the invention is schematically depicted in FIGS. 13–16. Thus, arrow holder 50i is shown, including line 52i with a single connector 54i in the form of an eye 56i. Cross bar 62i is releasably secured to a forwardly extending thin flat plate 64i by a screw 60i passing through a hole 110 in plate 64i. Plate 64i may be releasably secured to the outside of riser 24i, as by a layer 112 of adhesive (FIG. 13) or by a bolt 114 (FIG. 14) running through a U-shaped opening 116 in the front of plate 64i. Bolt 114 may, for example, be part of a conventional cushion plunger assembly 118 (FIG. 16).

Bar 62i is provided with a collar 72i releasably secured thereto and rotatable therewith, as by screw 60i, to secure rearwardly extending pin 70i in any desired angled orientation. Pin 70i screws into collar 72i and is adjustable in length. Eye 54i slides on pin 70i (FIG. 15), releasably holding line 52i on arrow shaft 32i while shaft 32i is seated on rest 30i (FIG. 15) in window 28i of bow 22i. A modified form of rest 30i is shown in dotted outline in FIG. 16.

Plate 64i has a spaced pair of holes 120 and 122 through which line 52i is releasably threaded to hold it in place on plate 64i and to allow its length to be adjusted easily and rapidly. No eye 56i is required for such anchoring of line 52i to plate 64i. Accordingly, holder 50i is of an improved type.

Various other modifications, alterations and additions can be made in the improved archery bow assembly of the present invention, its components and parameters. All such changes, modifications, alterations and additions as are within the scope of the appended claims form part of the present invention.

What is claimed is:

1. An improved archery bow assembly, said assembly comprising, in combination:

a. an archery bow having i. a riser with handle, an arrow window and an arrow rest fixed adjacent to and extending into said window, ii. a pair of limbs secured to opposite ends of said riser, and iii. a bowstring inter-connected to said limbs; and b. an improved arrow holder, including i. a flexible, resilient elongated line bearing a slide connector on one end thereof, said line being frictionally engageable with the surface of an archery arrow, ii. anchoring means including a first adjustably positionable bracket extending toward said bowstring, and a transversely extending second adjustably positionable bracket connected to the rear portion of said first bracket and extending behind said window, said first bracket inter-connecting the opposite end of said line to said riser, and iii. smooth surfaced slide means of adjustable length and angle secured to said riser through said second bracket, facing toward said bowstring and slidably receiving said slide connector, said line being of sufficient length to extend from said anchoring means over an archery arrow when the arrow is on said rest and extend to said slide means so as to hold an arrow in place when on said rest until said line is slidably disengaged from said slide means by frictional engagement and rearward movement with such arrow when such is drawn rearwardly by said bowstring, said first and second brackets being interconnected L-shaped plates embracing the rear end of said riser, said second bracket including a bendable portion bearing a rearwardly extending pin comprising said slide means.

2. The improved assembly of claim 1 wherein said line includes an elastomeric outer surface and wherein said connector which slidably engages said slide means comprises one of a hook and eye.

3. The improved assembly of claim 1 wherein said line comprises an elongated coiled spring.

4. The improved assembly of claim 1 wherein said line includes a rubber band and wherein said connectors are hooks.

5. An improved archery bow assembly, said assembly comprising, in combination:

a. an archery bow having i. a riser with handle, an arrow window and an arrow rest fixed adjacent to and extending into said window, ii. a pair of limbs secured to opposite ends of said riser, and iii. a bowstring inter-connected to said limbs; and b. an improved arrow holder, including i. a flexible, resilient elongated line bearing a slide connector on one end thereof, said line being frictionally engageable with the surface of an archery arrow, ii. anchoring means including a first adjustably positionable bracket extending toward said bowstring, and a transversely extending second adjustably positionable bracket connected to the rear portion of said first bracket and extending behind said window, said first bracket inter-connecting the opposite end of said line to said riser, and iii. smooth surfaced slide means of adjustable length and angle secured to said riser through said second bracket, facing toward said bowstring and slidably receiving said slide connector, said line being of sufficient length to extend from said anchoring means over an archery arrow when the arrow is on said rest and extend to said slide means so as to hold an arrow in place when on said rest until said line is slidably disengaged from said slide means by frictional engagement and rearward movement with such arrow when such arrow is drawn rearwardly by said bowstring, said first bracket being a plate extending with said second bracket and slide means behind said riser and pivotably secured to said riser, said plate defining a spaced plurality of openings extending transversely therethrough adjacent the rear portion thereof, said slide connector-free end of said line being trained through said openings for releasably adjustable securement thereof.

6. The improved assembly of claim 5 wherein said plate has a cut away front portion adapted to receive a mounting bolt extending transversely through said riser.

7. The improved assembly of claim 5 wherein said plate bears an adhesive layer along a portion of the length thereof for releasably securing said plate to the side of said riser.

* * * * *